United States Patent [19]

Johnston

[11] Patent Number: 4,717,109

[45] Date of Patent: Jan. 5, 1988

[54] ADJUSTABLE TRAVELING MAHL AND MAGNETIC SUPPORT FOR MOUNTING ARTIST'S CANVASES

[76] Inventor: Walter G. Johnston, 10618 Rountree Rd., Los Angeles, Calif. 90064

[21] Appl. No.: 791,727

[22] Filed: Oct. 28, 1985

[51] Int. Cl.[4] ..... A47B 19/00

[52] U.S. Cl. ..... 248/441.1; 248/458; 248/449; 33/443

[58] Field of Search ..... 248/441.1, 444, 449, 248/458, 359.1; 33/435, 437, 443, 446, DIG. 1

[56] References Cited

U.S. PATENT DOCUMENTS

| | | | |
|---|---|---|---|
| 467,825 | 1/1892 | McCabe | 33/435 |
| 552,914 | 1/1896 | Laughlin et al. | 33/435 |
| 632,037 | 8/1899 | Bauer | 248/458 |
| 2,267,497 | 12/1941 | Farrow | 33/489 |
| 2,306,677 | 12/1942 | Ward | 33/438 |
| 2,586,097 | 2/1952 | Scheu | 248/457 |
| 2,708,328 | 5/1955 | Bryda | 33/434 |
| 2,713,723 | 7/1955 | Anderson | 33/435 |
| 2,763,241 | 9/1956 | Waggoner | 33/DIG. 1 |
| 3,015,906 | 1/1962 | Guth | 248/449 |
| 3,345,751 | 10/1967 | Barzee et al. | 33/435 |
| 3,393,456 | 7/1968 | Schrag | 33/467 |
| 3,646,683 | 3/1972 | Barzee | 33/434 |
| 3,746,992 | 7/1973 | Serembe | 33/DIG. 1 |
| 3,972,133 | 8/1976 | Parshall | 248/441.1 |
| 4,378,102 | 3/1983 | Portis, Jr. et al. | 248/460 |
| 4,558,522 | 12/1985 | Lance | 248/449 |

FOREIGN PATENT DOCUMENTS

| | | | |
|---|---|---|---|
| 85683 | 4/1895 | Fed. Rep. of Germany | 33/435 |
| 1058877 | 6/1959 | Fed. Rep. of Germany | 33/443 |

*Primary Examiner*—Richard J. Scanlan, Jr.
*Assistant Examiner*—Anthony Knight
*Attorney, Agent, or Firm*—William H. Maxwell

[57] ABSTRACT

A mahl in the form of a beam adjusted as to height over a base for support of an artist's canvas, with carriages at opposite sides of the base to carry the mahl in spaced relation over the base and supported canvas, with adjustment for said spaced relation, with braking to position the mahl between top and bottom ends of the base, and with a protractor turntable for universal disposition of the canvas with respect to the mahl.

16 Claims, 6 Drawing Figures

M
C
B
D
47
48'
48
13,23
31
50
35
5
25
24
26
30
14,23
36
32

13
23
B
11
31,32
34

M
41
47
46
49
A
43
39
48'
23
48
D
37
45
38
5
35,36
39,40
31,32

ADJUSTABLE TRAVELING MAHL AND MAGNETIC SUPPORT FOR MOUNTING ARTIST'S CANVASES

BACKGROUND OF THE INVENTION

This invention relates to an easel and a mahl for facilitating art work, it being a general object of this invention to provide an adjustable traveling mahl over a selectively positionable canvas frame held to the easel by magnetic means adapted for quick positioning and replacement as circumstances require.

The use of mahls is common practice among artist's, who use the device as a rest, usually supported upon a padded end of a stick-like member held by one hand in order to steady the other hand of the artist. Drafting boards and the like have been provided with moveable straight edges, and though there have been straight edges cambered across drawing surfaces, said camber has been minimal and in no way adjustable or sufficient to ensure clearance over a work such as an oil painting or water color painting. That is, prior art straight edges have not been used as a mahl for steadying the painter's hand, and they have not been adjustable such as to ensure adequate clearance over such a work. An object of this invention is to provide this adequate adjustment and clearance.

Straight edges maintained to operate horizontally over drawing boards is common practice, and elaborate guide rails, and rack and pinion, and cable systems have been resorted to for maintaining horizontal positioning at variations in height from bottom to top of the boards. Also, locks have been provided to hold a selected position, and balance means have been provided to carry the weight of the straight edge. However, there has been no prior art balance and braking means for positioning a mahl that can ensure sufficient stability to carry the force applied by the wrist or arm of an artist while applying paint with a brush or the like. Therefore, it is an object of this invention to provide a means that ensures stability of a mahl in a selected position where it can be secured as a stationary arm support for the artist.

Rotatable drawing boards are common practice, and in combination with adjustable straight edges. Such rotation has been angularly calibrated and the drawings taped thereto. However, these prior art drawing boards have not accomodated the traditional artist's canvas which is comprised of a wooden frame over which the canvas per se is stretched. The conventional straight edge rests upon or is immediate to the drawing surface. The thickness of a common canvas can vary considerably, and it has been found quite necessary that the mahl of the present invention be adjustable in height from the canvas supporting surface. Therefore, it is an object of this invention to provide for this adjustment of substantial height over the canvas supporting surface, and over the supported canvas and frame as well.

Heretofore, drawings only and not painting canvases have been taped to supporting table tops and/or drawing boards. And, removal and replacement thereof has been a considerable chore. It is therefore an object of this invention to provide facility by means of which replacement or selective placement is a mere manipulation of magnetic retainers that adhere to the supporting surface of the table, in this instance a rotatable table that can be universally positioned as may be required for maximum comfort of the artist when exercising this painting proceedures. In practice, the canvas support is a magnetic laminate, and the canvas retainers are magnetic supports.

The foregoing and various other objects and features of this invention will be apparent and fully understood from the following detailed description of the typical preferred forms and applications thereof, throughout which description reference is made to the accompanying drawings.

THE DRAWINGS

Figure 5:
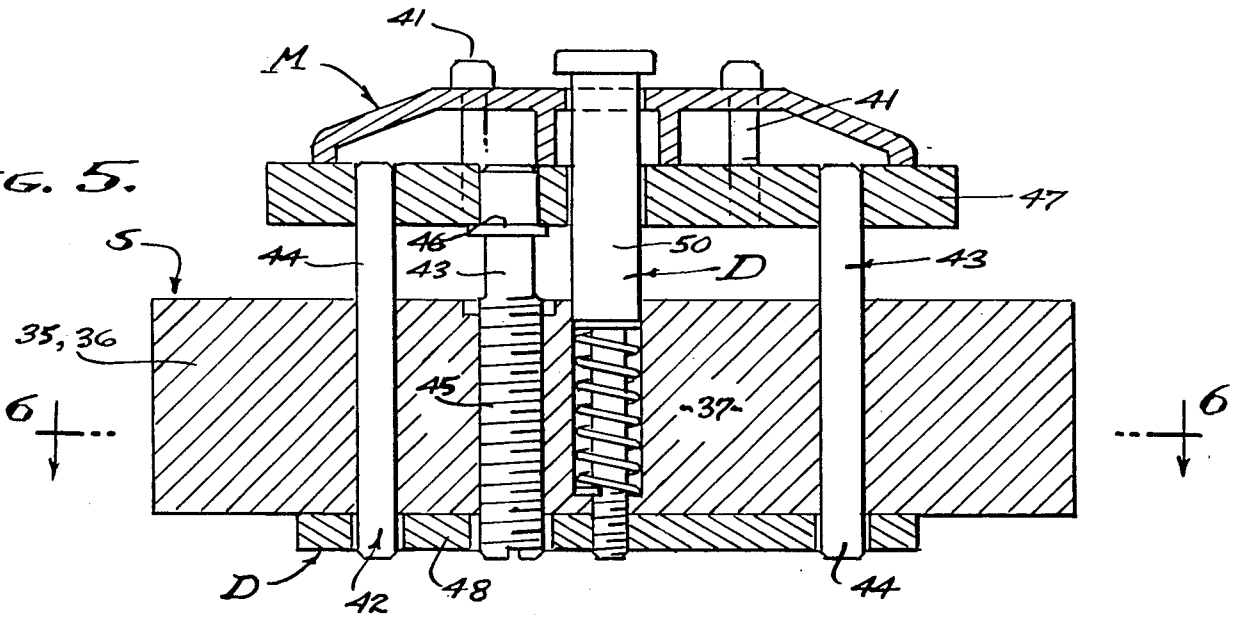
FIG. 5 is an enlarged detailed sectional view taken as indicated by line 5—5 on FIG. 3, showing the height adjustment and guides, and the brake release.
Figure 6:
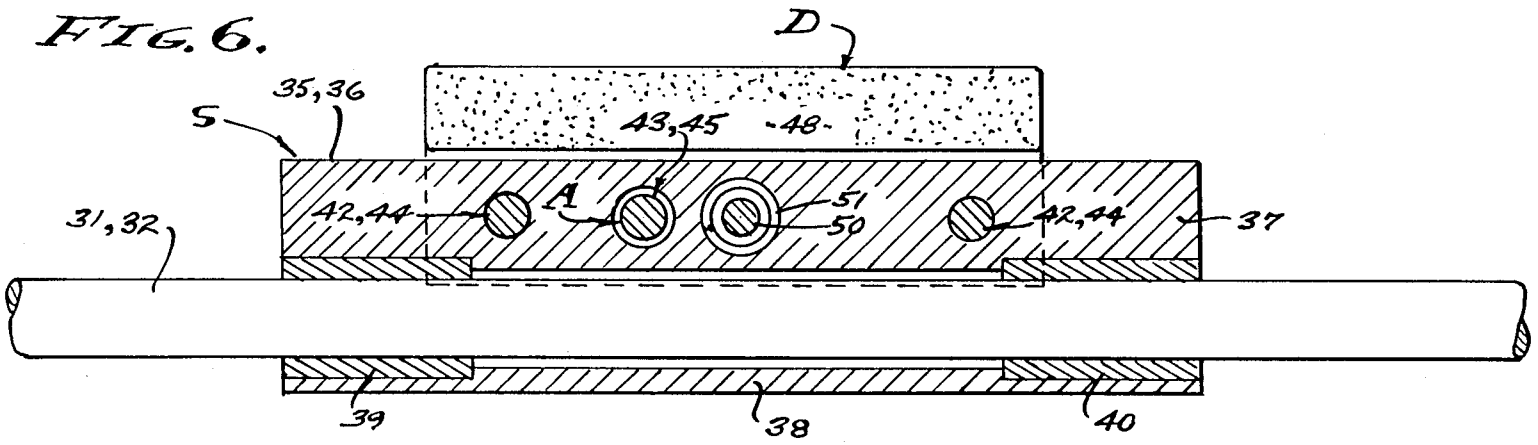

And, FIG. 6 is an enlarged detailed sectional view taken as indicated by line 6—6 on FIG. 5, showing the plan relationship of the various means involved, as will be described.

PREFERRED EMBODIMENT

Referring now to the drawings, there is a mahl M that is adjustable as to height over and moveable in parallel relation between top and bottom edges 10 and 11 of a base B. The artist's canvas C is superimposed upon the base B and a feature of this invention is that the mahl M passes over the canvas with clearance, as it is adjusted to the required height above base B to do so. The parallelism of mahl M with respect to the parallel top and bottom edges 10 and 11 is invariable, and angular adjustment with respect to the canvas is by means of a rotatably positionable table T carried by the base B. Another feature of this invention is the canvas mounting by means of magnetic attraction of retainers R by which canvases of various size are mounted onto the table T. In practice, the Traveling Mahl and Magnetic Support can be used as or on a table or more conventionally it is used nearer to a vertical position and is therefore advantageously supported by an easel E as clearly shown in FIG. 1 of the drawings. Accordingly, the weight of the traveling mahl M and its associated means is counterbalanced by means G. This invention is characterized by the slide means S that maintains the aforesaid parallelism of the mahl M as it travels between top and bottom edges 10 and 11 of the base B, by brake means D that secures the mahl M in a selected position from top to bottom edge, and by height adjustment means A that positions the mahl M at a selected height over the surface of the base B and/or adjustable table T, and with clearance over the work in the form of an artist's canvas C or the like.

The easel E is shown as a frame 15 having a transverse foot 16 with upstanding parallel columns 17 joined by a header 18. A vertically adjustable support member 19 operates between the columns 17, with a clamp 20 in opposition to a clamp 21 at or beneath the header, the clamp 21 being vertically adjustable. An adjustable rear leg 22 angularly positions the easel. Accordingly, the easel E provides horizontally disposed and parallel clamps 20 and 21 which are adjusted in opposition to a desired height and angularity, all as circumstances require for the support of the base B as shown secured therebetween.

Referring now to the traveling mahl and magnetic canvas support, the base B is a flat planar member having the top and bottom edges 10 and 11 and vertical side edges 13 and 14. The base B is preferably a square adapted to be held to the frame 15 of the easel E by clamps 20 and 21 thereof. With the easel E upright as shown, the side edges 13 and 14 are substantially vertical, though they are usually slanted to certain degree. In practice, the base B is made of plywood or fiber board with edge binding of metal channel 23 which presents flat and smooth parallel margins at both the front and back sides of the base. These side margins, of channels 23, cooperate with the brake means D later described.

The artist's canvas C could be carried directly upon the front face of base B, however it is most advantageous to rotate the canvas into different positions. Therefore, the rotatably positionable table T is provided and carried by the base B concentrically therein, or thereover, within the confines of the side margins defined by the side channels 23. The table T is a circular member that turns freely on a central bearing which may vary widely in construction. As shown, the turning axis is established by a concentric opening 24 through the base B, through which arcuate bearing blocks 25 bear within the opening, and with keepers 26 carried by the blocks to slideably engage the back side of the base. The rotative position of the table T can be set by a lock screw 27, and its position determined and indicated by cardinal points 28 thereon to be associated with protractor scale 29. In practice, the scale 29 extends and is marked through 45° and the cardinal points 28 are spaced at 45°, the scale 29 being carried by the base at the periphery of the table, and the cardinal points being at the periphery of the table.

Figure 1:
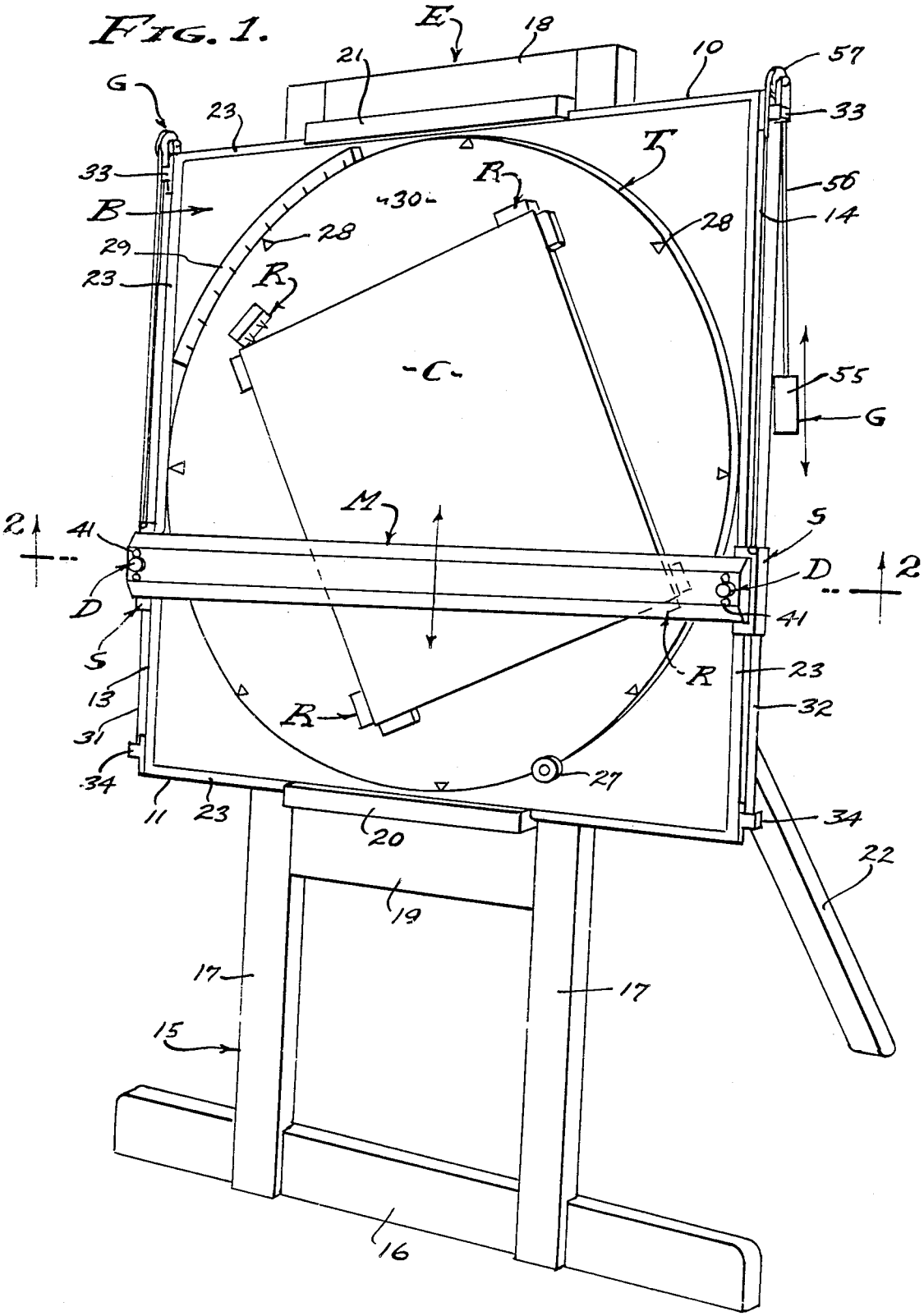
FIG. 1 is a perspective view showing the Adjustable Traveling Mahl and Magnetic Support of the present invention mounted upon a typical artist's easel, with a canvas carried thereby beneath the mahl and angularly adjusted in order to facilitate the artist's work.
Figure 2:
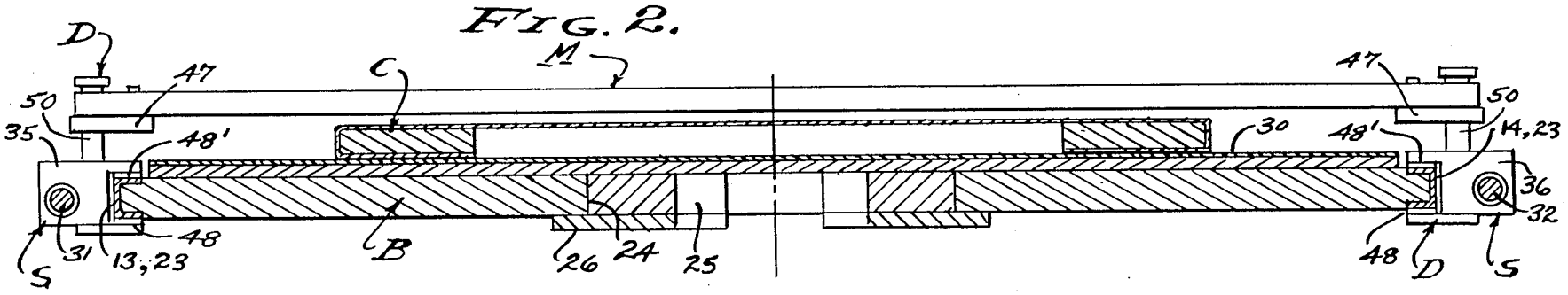
FIG. 2 is an enlarged transverse sectional view taken substantially as indicated by line 2—2 on FIG. 1, and showing the adjusted height of the mahl above the canvas carried by an adjustably rotatable table.

A feature of this invention is the magnetic mounting of the artist's canvas C by retainers R that are selectively positioned upon the table T as may be required. In carrying out this invention, the table T is a laminate member with a ferrous facing 30 in the form of sheet iron or steel, carried by a plywood or fiber board backing. The retainers R are magnet blocks which are omni or universally positionable, there being at least one retainer R per side of the canvas C to be mounted. As shown, there is a pair of retainers R at each corner of the canvas C, it being understood that the two angularly related retainer blocks can be integral legs of a single supporting retainer. The retainers R are spiked as shown in FIG. 1, so as to bite into the the frame of the canvas. Thus, the canvas can be located as desired, and its position easily altered from time to time as may be required.

Figure 4:
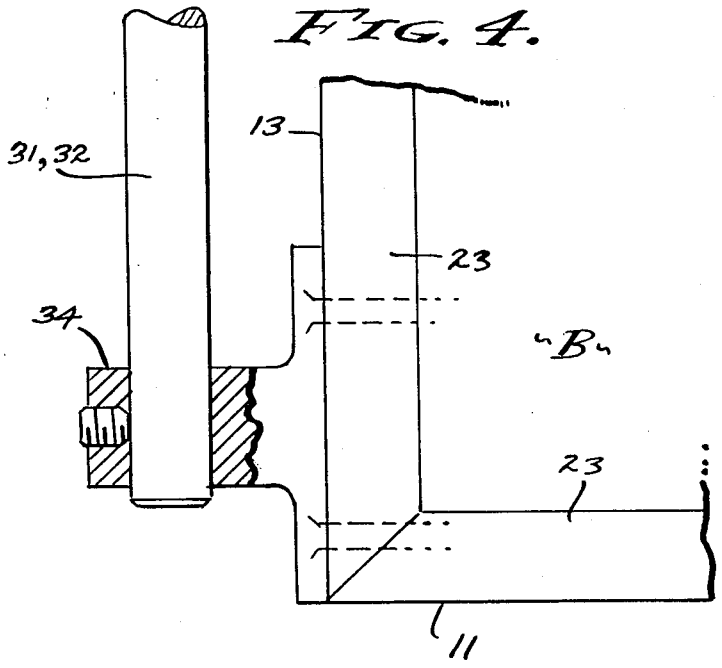
FIG. 4 is an enlarged detailed fragmentary view of one of the four corners and the base member, showing slide bar mounting, as shown at the right and left hand edges in FIG. 1.

Referring now to the traveling mahl M, it is a feature of this invention that the mahl M is a rigid bar or beam-like member extending transversely over the base B and adjusted to a height spaced from the front of the base B and overlying the table T, a distance to provide clearance from the canvas C mounted thereon. A requirement is that the mahl M be moveable over the canvas C, between and in parallel relation to the top and bottom edges 10 and 11 of the base B. To this end there is provided the slide means S that maintains the aforesaid parallelism of the mahl M as it travels over the canvas C with clearance. As shown, the slide means S comprises a rod or guide bar 31 and 32 disposed outside of and parallel to each of the side edges 13 and 14, and carriages 35 and 36 slideable on those respective bars, so as to move substantially vertically when the base B is so disposed. In practice, the bars 31 and 32 are centerless ground accurately round steel bars carried in spaced relation to edges 13 and 14 defined by the opposite side channels 23 and carried by brackets 33 and 34 at the top and bottom corners of the base B (see FIG. 4).

Figure 3:
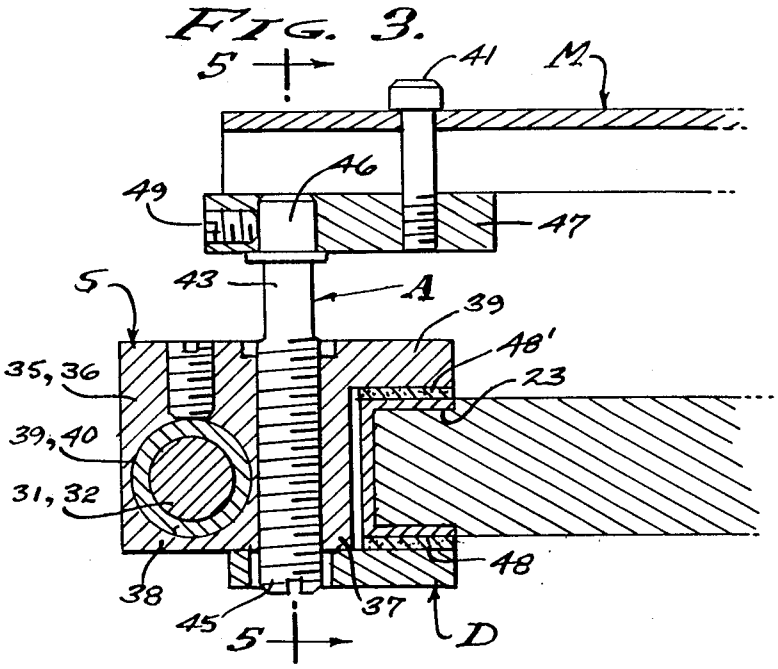
FIG. 3 is an enlarged detailed fragmentary view of the left hand mahl support and its associated parts and members, the right hand mahl support being a mirror opposite.

The bars 31 and 32 are on coplanar parallel axes disposed between the extended planes of the front and back of the base B. The carriages 35 and 36 are alike and each includes a body portion 37 occupying the space between the supporting bar 31,32 and side channel 23, a body portion 38 through which the bar 31,32 slides, and a body portion 39, integral or separate, overlying the marginal front of the side edge channel 23 (see FIG. 3). As shown, the carriages 35 and 36 have guide bushings 39 and 40 which travel over the bar 31,32 for guided vertical engagement therewith. The guide bushings 39 and 40 are substantially spaced with the mahl M securely attached and rigidly adjustable as to height between the two opposite side carriages 35 and 36, being secured thereto directly or indirectly by screw fasteners 41. The mahl M is disposed horizontally at right angles so the slide bars 31 and 32 (see FIG. 1).

In accordance with this invention, I provide the height adjustment means A that determines the spaced relationship of the mahl M from the base B etc., at the opposite side ends thereof. The adjustment means A is accomodated in the body portion 37 of each carriage 35 and 36, the opposite side ends of the mahl M being individually adjustable as to height from the base B. As shown, the adjustment means A comprises guide means 42 for maintaining angularity of the mahl M and the carriages 35 and 36 while permitting adjustable separation thereof, and comprises selectively positionable support means 43 between the mahl M at the opposite ends thereof supported by the carriages 35 and 36. Like the guide means 42, the support means 43 is also accomodated in the body portion 37, of each carriage 35 and 36.

The guide means 42 for maintaining angularity of the mahl M and carriages 35 and 36 comprises spaced and parallel guide pins 44 extending through the mahl and carriages, and slideable in one or the other. In practice, there is a pair of pins 44 pressed into and carried at each end of the mahl and slideable through spaced parallel openings into the carriages. The axes of pins 44 are normal to a plane coincidental with the axes of the bars 31 and 32. Horizontal parallelism of the mahl is thereby maintained while it is free to be changed in proximity to the base B, the table T and the canvas C.

The support means 43 determines the spaced relationship of the mahl M from the base B etc., and it comprises a jack 45 in the form of a threaded column having a flange shoulder 46 engageable with the back side of the mahl M to lift it to selected positions spaced from the base B. The jack-screw 45 is threaded through the body portion 37 of the carriage (35–36) where it is slotted or otherwise fashioned to be operated by a hand tool or the like. In practice, there is a header 47 at each end of the mahl M, to carry the pins 44 and to receive the shouldered jack 45. As next described, the headers 47 also pass a manually depressible control rod for the brake means D.

The brake means D secures the mahl M in any selected position between the top and bottom edges 10 and 11 of base B, and is comprised of releasable friction means at one or both of the carriages 35 and 36. In practice, there is a manually releasable friction pad 48 disengageable from the margin of the base B defined by the channel 23. As shown, the pad 48 is comprised of a brake lining carried by a back plate guided by the pins 44 and with an access opening for the operating jack 45. The jack 45 has a set screw 49 carried by the header 47 to engage a head thereof above said flange shoulder 46. The header 47 and mahl M freely pass a control rod 50 for depressing the pad 48, thereby releasing it from the channel 23.

The braked means D is normally set and the pad 48 yieldingly urged into pressured engagement with the channel 23 by a spring 51 operable over a reduced portion of the rod 50 extending through the bottom of the body portion 37 to engageably carry the pad 48. The control rod 50 is shouldered so as to be lifted by the spring 51 carried over the reduced portion of the rod, and there is a manually engageable button exposed at or above the mahl for manual depression of the rod and attached brake pad 48. In the preferred form, the brake means D is of the caliper type, wherein the moveable brake pad 48 is opposed by a static brake pad 48' carried by the body portion 39 and engageable with the opposite front side of the channel 23. The pads 48' at each end of the mahl M have a dual function of positioned support for the mahl as well as for braking.

The weight of the mahl M and of the dynamic means associated therewith as hereinabove described is counterbalanced by a gravity pulled weight 55 drawing a cable 56 over a pulley 57 at each side of the base B, the cables of such means being attached to the carriages 35 and 36 as shown.

From the foregoing, it will be understood that I have provided a news and useful traveling mahl suitable for use by artists, in order to steady the working hand and brush with respect to the canvas. Also to universally turn the canvas with respect to the mahl. It is to be observed that the artist's posture remains erect and comfortable, while executing otherwise difficult brush strokes, since the table carrying the canvas can be readily turned to any rotational position. Further, the canvas can be prepared with suitable grids, guide lines, and/or perspective lines in preparation to execution of a painting, or those control lines checked from time to time, by using the calibrated protractor and cardinal points. Positioning of the canvas on the table is facilitated by the magnetic ratainers that support and bite into the canvas frame. The foregoing is made possible by the rigid positioning of the mahl and its releasable placement over the canvas by the brake means, and by the adjustable clearance over the canvas by height adjustment means in the form of screw jacks. The traveling mahl and magnetic support for artist's canvases is used most advantageously when mounted on an easel as shown Having described only the typical preferred form and applications of my invention, I do not wish to be limited or restricted to the specific details herein set forth, but wish to reserve to myself any modifications or variations that may appear to those skilled in the art as set forth within the limits of the following claims.

I claim:

1. A traveling mahl and support for an artist's canvas comprised of a frame over which a canvas is stretched, and including;

a planar base with a flat artist's canvas supporting surface and having parallel opposite side edges extending between top and bottom edges, slide means for movement at and along each opposite side edge of the base and comprised of a member coextensive with each opposite side edge of the base and a carriage slideably engaged on each member and to which opposite ends of the mahl are attached by height adjustment means comprised of a manually adjustable jack between each carriage and the opposite end of the mahl, there being guide pins standing between each carriage and the opposite ends of the mahl for rigid transverse positioning and selective placement of the mahl over the base, the mahl being in the form of a rigid member carried by and extending transversely between the slide means at opposite side edges of the base and carried thereby to travel in spaced relation over the supporting surface of the base and the artist's canvas thereon, and releasable brake means at and securing the slide means at each opposite side edge of the base for positioning the mahl between the top and bottom edges of the base.

2. The traveling mahl and support as set forth in claim 1, wherein a ferrous laminate is carried over the base, there being retainer magnets selectively positioned upon the laminate and engageable with said artist's canvas to position the same.

3. The traveling mahl and support as set forth in claim 1, wherein the brake means comprises a manually operable brake pad disengageable from at least one side edge of the base.

4. The traveling mahl and support as set forth in claim 1, wherein the brake means comprises a spring engaged brake pad disengageable from at least one side edge of the base.

5. The traveling mahl and support as set forth in claim 1, wherein the brake means comprises a caliper embracing at least one side edge of the base, said caliper having opposite brake pads and one of which is spring biased and manually disengageable from the side edge of the base.

6. A traveling mahl and easel support for an artist's canvas comprised of a frame over which a canvas is stretched, and including;

an upstanding substantially vertically disposed easel, a planar base supported substantially vertically by the easel and having parallel opposite side edges extending between top and bottom edges.

a planar turntable carried by and within the confines of the edges of the base and having a flat surface to support and rotatably position said artist's canvas thereon, slide means for movement at and along each opposite side edge of the base, a mahl in the form of a rigid member carried by and extending transversely between the slide means at opposite side edges of the base and carried thereby to travel in spaced relation over the supporting surface of the turntable and clear of said artist's canvas supported thereon, and releasable brake means at and securing the slide means at each opposite side edge of the base for positioning the mahl between the top and bottom edges of the base.

7. The traveling mahl and easel support as set forth in claim 6, wherein a ferrous laminate is carried over the turntable, there being retainer magnets selectively positioned upon the laminate and engageable with said artist's canvas to position the same.

8. The traveling mahl and easel support as set forth in claim 6, wherein the slide means comprises a member coextensive with each opposite side edge of the base and a carriage slideably engaged on each member and to which opposite ends of the mahl member are attached by height adjustment means for selective placement of the mahl member over the turntable.

9. The traveling mahl and easel support as set forth in claim 8, wherein the height adjustment means comprises a manually adjustable jack between each carriage and the opposite ends of the mahl member.

10. The traveling mahl and easel support as set forth in claim 8, wherein the height adjustment means comprises a manually adjustable jack between each carriage and the opposite ends of the mahl member, there being guide pins standing between each carriage and the opposite ends of the mahl member for rigid transverse positioning of said mahl member.

11. The traveling mahl and easel support as set forth in claim 6, wherein the brake means comprises a manually operable brake pad disengageable from at least one side edge of the base.

12. The traveling mahl and easel support as set forth in claim 6, wherein the brake means comprises a spring engaged brake pad disengageable from at least one side edge of the base.

13. The traveling mahl and easel support as set forth in claim 6, wherein the brake means comprises a caliper embracing at least one side edge of the base, said caliper having opposite brake pads and one of which is spring biased and manually disengageable from the side edge of the base.

14. The traveling mahl and easel support as set forth in claim 6, wherein the slide means comprises a member coextensive with each opposite side edge of the base and a carriage slideably engaged on each member and to which opposite ends of the mahl member is attached by height adjustment means for selective placement of the mahl member over the turntable, and wherein the brake means comprises a manually operable brake disengageable from at least one side edge of the base.

15. The traveling mahl and easel support as set forth in claim 8, wherein the height adjustment means comprises a manually adjustable jack between each carriage and the opposite ends of the mahl member, and wherein the brake means comprises a spring engaged brake pad disengageable from at least one side edge of the base.

16. The traveling mahl and easel support as set forth in claim 8, wherein the height adjustment means comprises a manually adjustable jack between each carriage and the opposite ends of the mahl member, there being guide pins standing between each carriage and the opposite ends of the mahl member for rigid transverse positioning of said mahl member, and wherein the brake means comprises a caliper embracing at least one side edge of the base, said caliper having opposite brake bads and one of which is spring biased and manually disengageable from the side edge of the base.

* * * * *